US007324658B2

(12) United States Patent
Kobayashi

(10) Patent No.: US 7,324,658 B2
(45) Date of Patent: Jan. 29, 2008

(54) SPEAKER

(75) Inventor: Shinji Kobayashi, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/466,223

(22) PCT Filed: Nov. 7, 2002

(86) PCT No.: PCT/JP02/11612

§ 371 (c)(1),
(2), (4) Date: Nov. 6, 2003

(87) PCT Pub. No.: WO03/043375

PCT Pub. Date: May 22, 2003

(65) Prior Publication Data

US 2004/0062414 A1 Apr. 1, 2004

(30) Foreign Application Priority Data

Nov. 14, 2001 (JP) ..... 2001-348525

(51) Int. Cl.
*H04R 25/00* (2006.01)

(52) U.S. Cl. ..... 381/396; 381/398; 381/412

(58) Field of Classification Search ..... 381/396, 381/398, 400, 407, 429, 430, 433
See application file for complete search history.

(56) References Cited

U.S. PATENT DOCUMENTS 3,614,335 A * 10/1971 Dymoke-Bradshaw et al. .. 381/398
5,590,211 A * 12/1996 Chang ..... 381/398

FOREIGN PATENT DOCUMENTS

| | | | |
|---|---|---|---|
| JP | 62-141895 | A | 6/1987 |
| JP | 09 084188 | A | 3/1997 |
| JP | 62 141895 | A | 6/1997 |
| JP | 10 271587 | A | 10/1998 |
| JP | 10-271587 | A | 10/1998 |
| JP | 2000 175292 | A | 6/2000 |

* cited by examiner

*Primary Examiner*—Suhan Ni
(74) *Attorney, Agent, or Firm*—Wolf, Greenfield & Sacks, P.C.

(57) ABSTRACT

A speaker includes a diaphragm having a central aperture at which a bobbin with a voice coil wound therearound is mounted, and mounted at the outer periphery thereof on a frame with an edge therebetween, and a magnetic circuit section that has a magnetic gap in which the bobbin is placed, and that drives the diaphragm to vibrate in the frontward and rearward direction. The speaker can use a larger diaphragm by providing the frame with an edge-mounting portion on which the edge is mounted, and a portion formed in front of the edge-mounting portion.

3 Claims, 6 Drawing Sheets

SPEAKER

TECHNICAL FIELD

The present invention relates to a novel speaker. More particularly, the present invention relates to a technique that permits the use of a diaphragm that is large for the outer diameter.

BACKGROUND ART

An example a of a conventional speaker is shown in FIGS. 5 and 6.

In the speaker a, required components and members are supported by a frame b. That is, the outer periphery of a diaphragm c is supported at a front end face of the frame b with an edge d therebetween. A voice coil is connected to the inner periphery of the diaphragm c with an unshown bobbin therebetween, and a magnetic circuit section for forming a magnetic field necessary to drive the diaphragm, that is, the voice coil is supported by the frame b.

A flange portion e is formed at the front end of the frame b to serve as a mounting portion projecting toward the center, and the edge d is supported on the front face of the flange portion e by, for example, bonding. A gasket f is mounted by, for example, bonding outside a portion of the front face of the flange portion e in which the edge d is supported.

When the speaker a is mounted at a predetermined mounting position, the frame b is fixed at its rear end, and the gasket f at the front end is abutted on a predetermined portion.

In the above-described conventional speaker a, both the edge d and the gasket f must be mounted on the front face of the flange e formed at the front end of the frame b. Therefore, a space in which the gasket f is mounted must be formed outside the portion in which the edge d is mounted. For this reason, the width L of the flange is increased. That is, the outer diameter of the front end of the frame b is increased by a length corresponding to the space in which the gasket f is mounted.

The maximum size of a speaker to be mounted in a limited space, for example, the interior of a car, is limited. For example, in a case in which the space in which the front end of the speaker is placed is limited, the size of the front end, that is, the outer diameter of the front end is limited.

In the above conventional speaker a, the maximum outer diameter of the front end of the frame b is limited by the condition of the space for the mounting portion. A mounting face for the gasket f must be provided outside a mounting face for the edge d on such a condition, and therefore, the outer diameter of the diaphragm c must be reduced by a length corresponding to the mounting face for the gasket f.

The characteristics of the speaker greatly depend on the size of the diaphragm. As the size of the diaphragm increases, the frequency characteristic is improved, the sound pressure is improved, and as a result, the sound quality is improved. In the above conventional speaker a, however, since the gasket f and the edge d are mounted on the same flange e, the outer diameter of the diaphragm c must be reduced to ensure a mounting face for the gasket f.

Accordingly, an object of the present invention is to use, in a speaker whose maximum outer diameter is limited, a diaphragm that is large for the outer diameter.

DISCLOSURE OF THE INVENTION

A speaker of the present invention includes a frame for supporting a magnetic circuit section, a voice coil, and a diaphragm connected at the inner periphery thereof to the voice coil and supported at the outer periphery thereof at a leading end of the frame with an edge therebetween, wherein an edge flange portion (mounting portion) for supporting the edge, and a gasket flange portion placed in front of the edge flange portion so that at least a part thereof overlaps with the edge flange portion in the frontward and rearward direction project toward the center at the leading end of the frame, and a gasket is supported by the gasket flange portion.

Since the gasket flange portion for supporting the gasket is provided in front of the edge flange portion for supporting the edge, the outer diameter of an edge mounting portion will not be increased because of mounting of the gasket. Therefore, when the speaker has the same outer diameter as that of the conventional speaker, it can use a diaphragm having an outer diameter larger than that in the conventional speaker. This can improve the sound quality.

By forming the edge flange portion and the gasket flange portion integrally with the frame, the number of components can be reduced, and the cost can be reduced.

When the frame is formed by combining a main frame portion having the edge flange portion and a front frame portion having the gasket flange portion which frame portions are separate from each other, the front frame portion is connected to the main frame portion after the diaphragm is supported at the edge flange portion with the edge therebetween. This can simplify the step of supporting the diaphragm.

BRIEF DESCRIPTION OF THE DRAWINGS

Speakers according to embodiments of the present invention will be described below with reference to the attached drawings.

Figure 1:
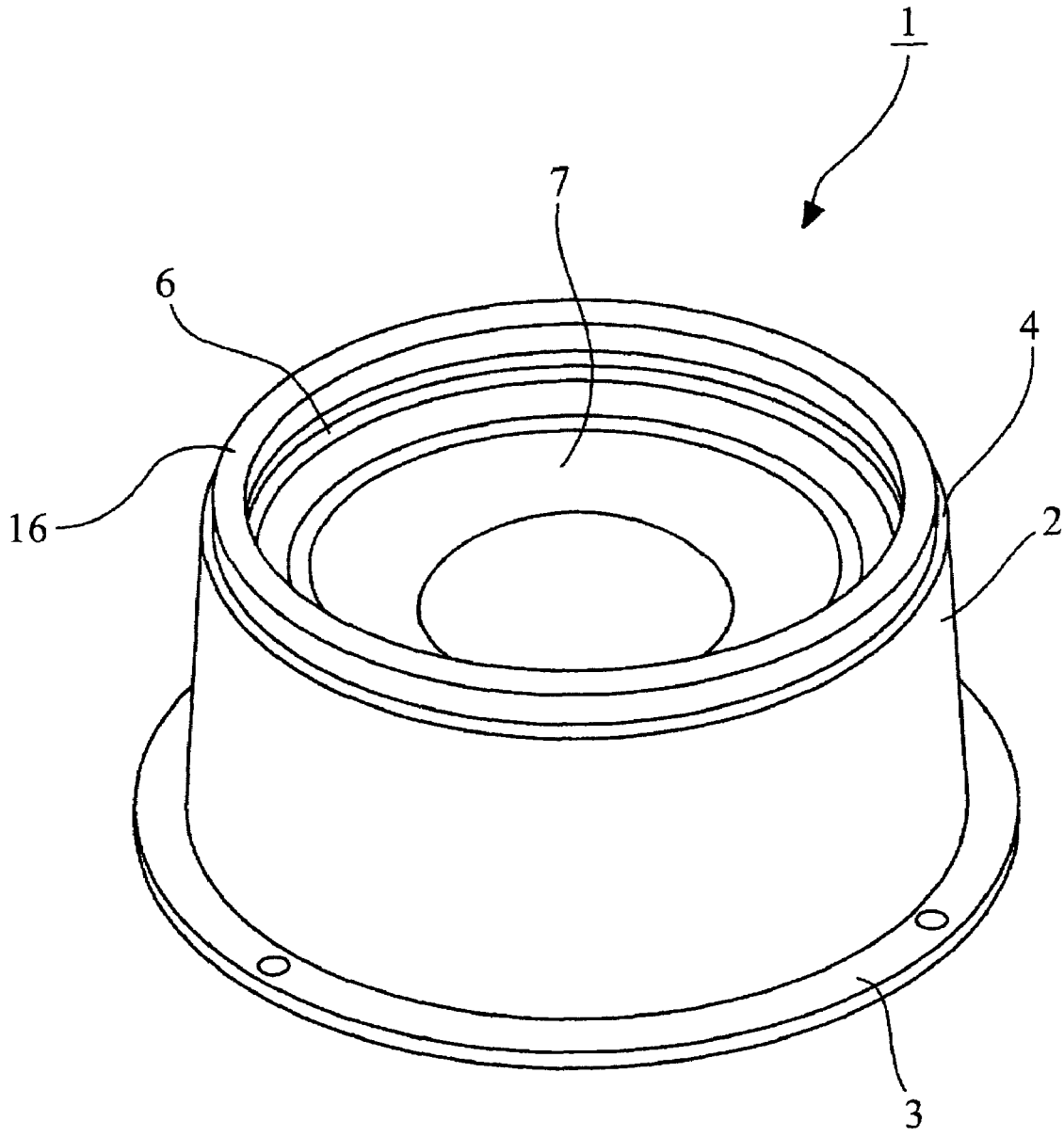
FIG. 1 shows a speaker according to a first embodiment of the present invention, in conjunction with FIGS. 2 and 3, and is a schematic perspective view thereof.
Figure 2:
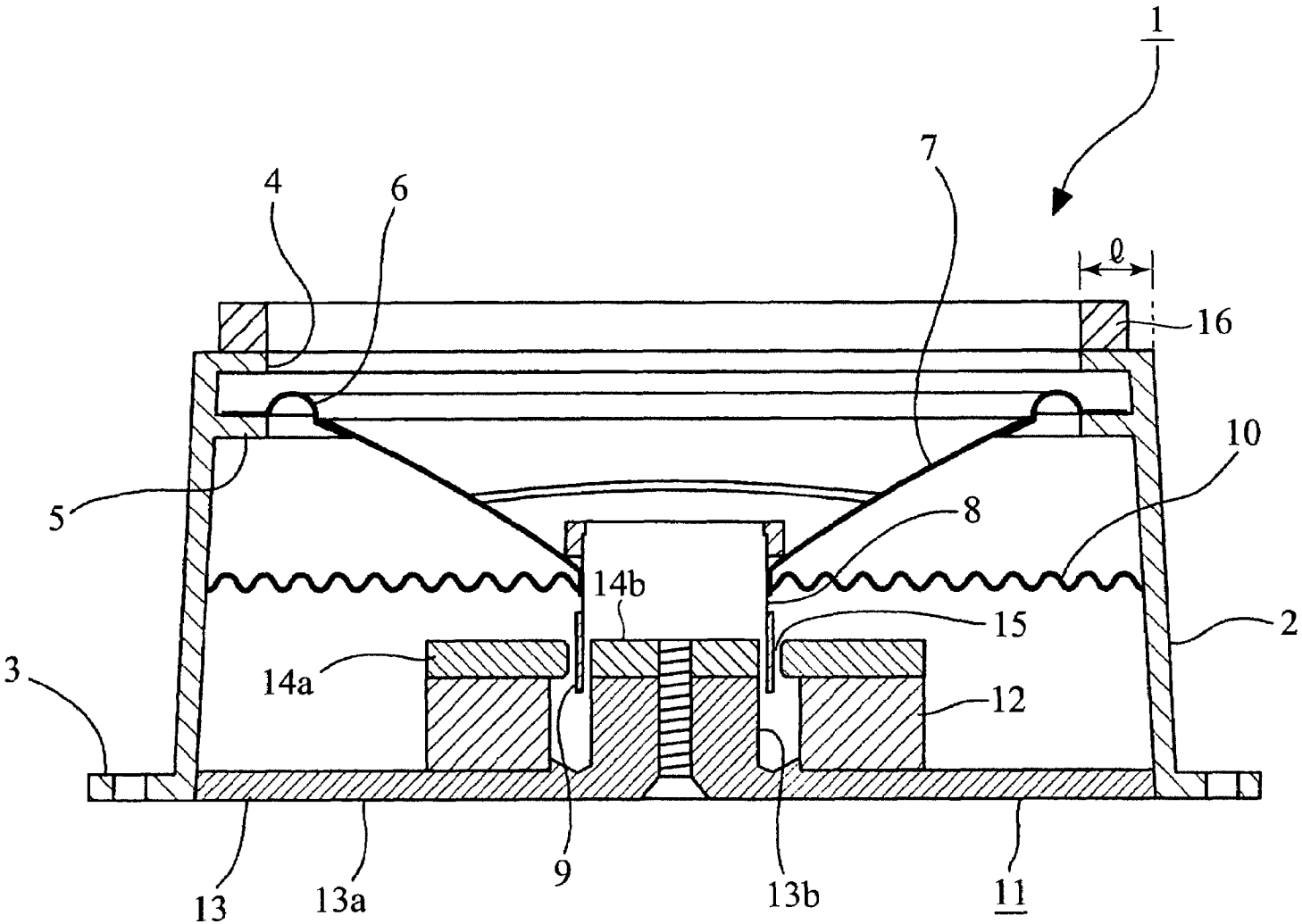
FIG. 2 is a longitudinal sectional view.
Figure 3:
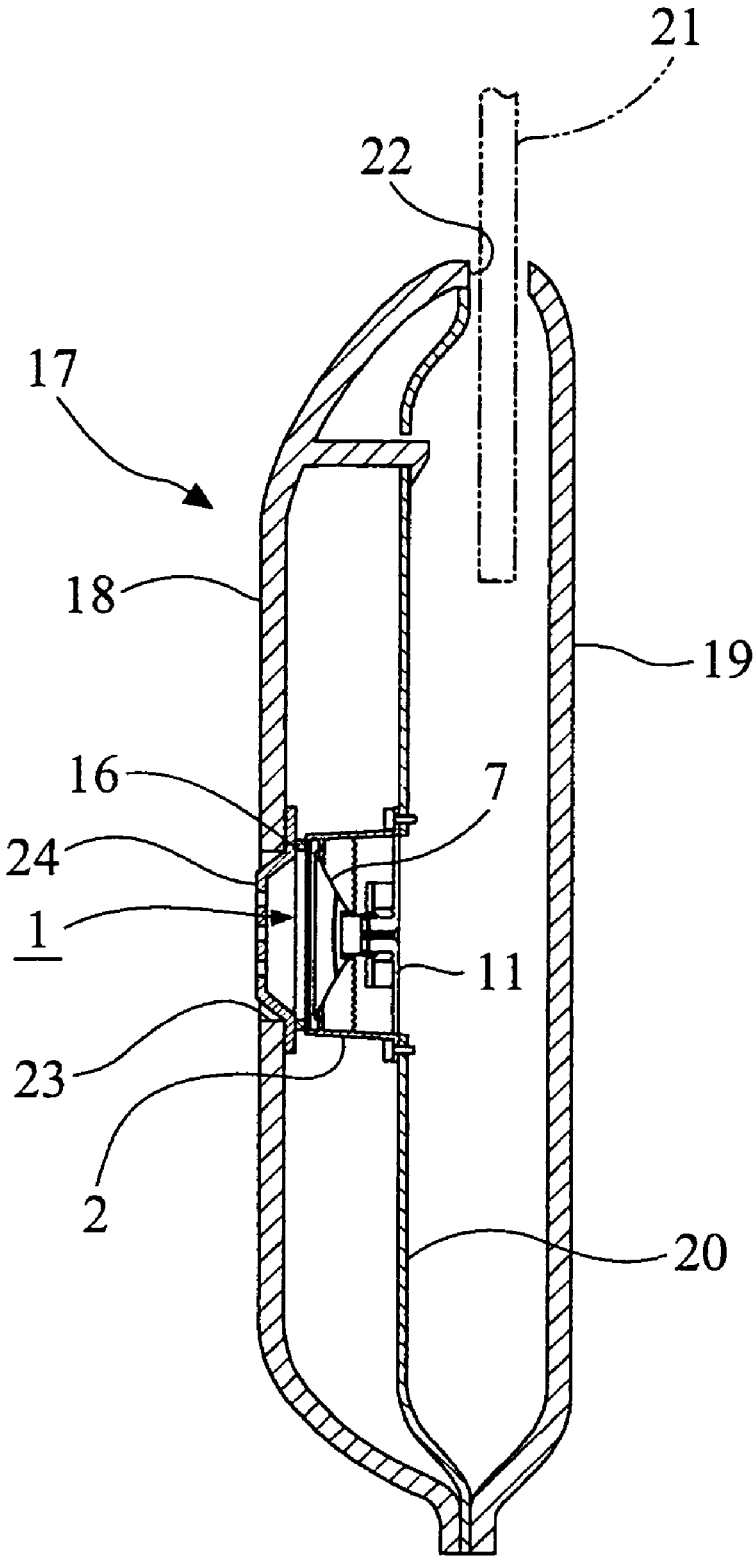
FIG. 3 is a schematic sectional view showing a mounting example.

FIGS. 1 to 3 show a speaker according to a first embodiment of the present invention.

A speaker 1 has a substantially cylindrical frame 2, and required members are supported in the frame 2. The frame 2 is tapered so that the diameter is slightly larger at its rear end than at its front end, and a mounting flange portion 3 projects outward from the rear end. Two flange portions 4 and 5 spaced in the frontward and rearward direction project inward at the front end of the frame 2. A front one 4 of the two flange portions 4 and 5 serves as a gasket-mounting portion, and a rear one 5 serves as an edge-mounting portion. The frame 2 is, for example, a resin-molded piece having the flange portions 3, 4, and 5 integrally formed therewith.

An outer peripheral portion of a diaphragm (paper cone) 7 is supported at the flange portion 5 serving as the edge-mounting portion in the frame 2 with an edge 6 therebetween. The diaphragm 7 is conical, and an inner peripheral portion thereof is connected to the front end of a substantially cylindrical coil bobbin 8. A voice coil 9 is wound around the coil bobbin 8. The coil bobbin 8 is supported in the frame 2 by a damper 10.

A magnetic circuit section 11 is supported by the frame 2. The magnetic circuit section 11 includes a magnet 12, and a bottom plate 13 and top plates 14*a* and 14*b* that are made of a magnetic material. A center pole 13*b* projects forward from the center of a disc-shaped rear face portion 13*a* of the bottom plate 13, and the magnet 12 shaped like a ring is fixed to the front face of the rear face portion 13*a*. The top plate 14*a* shaped like a ring is fixed to the front face of the magnet 12. The central top plate 14*b* is fixed to the front face of the center pole 13*b* by a screw. A gap 15 is formed between an inner peripheral surface of the top plate 14*a* and an outer peripheral surface of the center pole 13*b*, and the gap 15 serves as a magnetic gap.

The magnetic circuit section 11 is fixed inside the frame 2, and the voice coil 9 is placed in the gap 15 of the magnetic circuit section 11.

When an electrical signal is applied to the voice coil 9, a driving force is generated in the voice coil 9 that is placed in the gap 15, that is, in the magnetic field and that is a conductor through which a current flows, and is transmitted to the diaphragm 7, and the diaphragm 7 vibrates in the frontward and rearward direction, thereby radiating sound in response to the vibrations.

A gasket 16 made of an elastic material, for example, rubber, synthetic rubber, or resin foam such as urethane foam, is fixed to the front face of the flange portion 5 serving as the gasket-mounting portion by bonding or by other methods.

Mounting of the speaker 1 in, for example, the door of a car will be described with reference to FIG. 3.

In a door 17 of a car, an inner side plate 20 as a structural member is placed between a door trim 18 on the interior side and an outer side plate 19 on the external side, and an opening 22 through which a door glass 21 comes in and out is formed between the outer side plate 19 and the inner side plate 20 at the upper end of the door 17. The, door trim 18 has a mounting hole 23 through which the speaker 1 faces the interior, and a grille 24 having multiple pores is mounted to cover the mounting hole 23. The mounting flange portion 3 formed at the rear end of the frame 2 of the speaker 1 is screwed to the inner side plate 20, and the gasket 16 fixed to the front face of the gasket flange portion 4 of the frame 2 is in contact with the periphery of the grille 24 at the front end of the frame 2.

In the above-described speaker 1, the flange portion 4 for mounting the gasket 16 is separate from the mounting portion for mounting the edge 6, that is, the flange portion 5, and the gasket flange 4 portion is placed in front of the edge flange portion 5 so that at least a part thereof overlaps with the edge flange portion 5, as viewed from the front side. Therefore, there is no need to form a space outside the edge 6 in which the gasket 16 is placed, and the width 1 of the flange portions 4 and 5 is reduced. Consequently, when the outer dimensions of the frame 2 are unchanged, the width 1 is smaller than the width L in the conventional art, and the outer dimensions of the diaphragm 7 can be increased. By increasing the outer diameter of the diaphragm 7, the characteristics, in particular, in the low sound range are improved, sound pressure is improved, and as a result, sound quality is improved.

Figure 4:
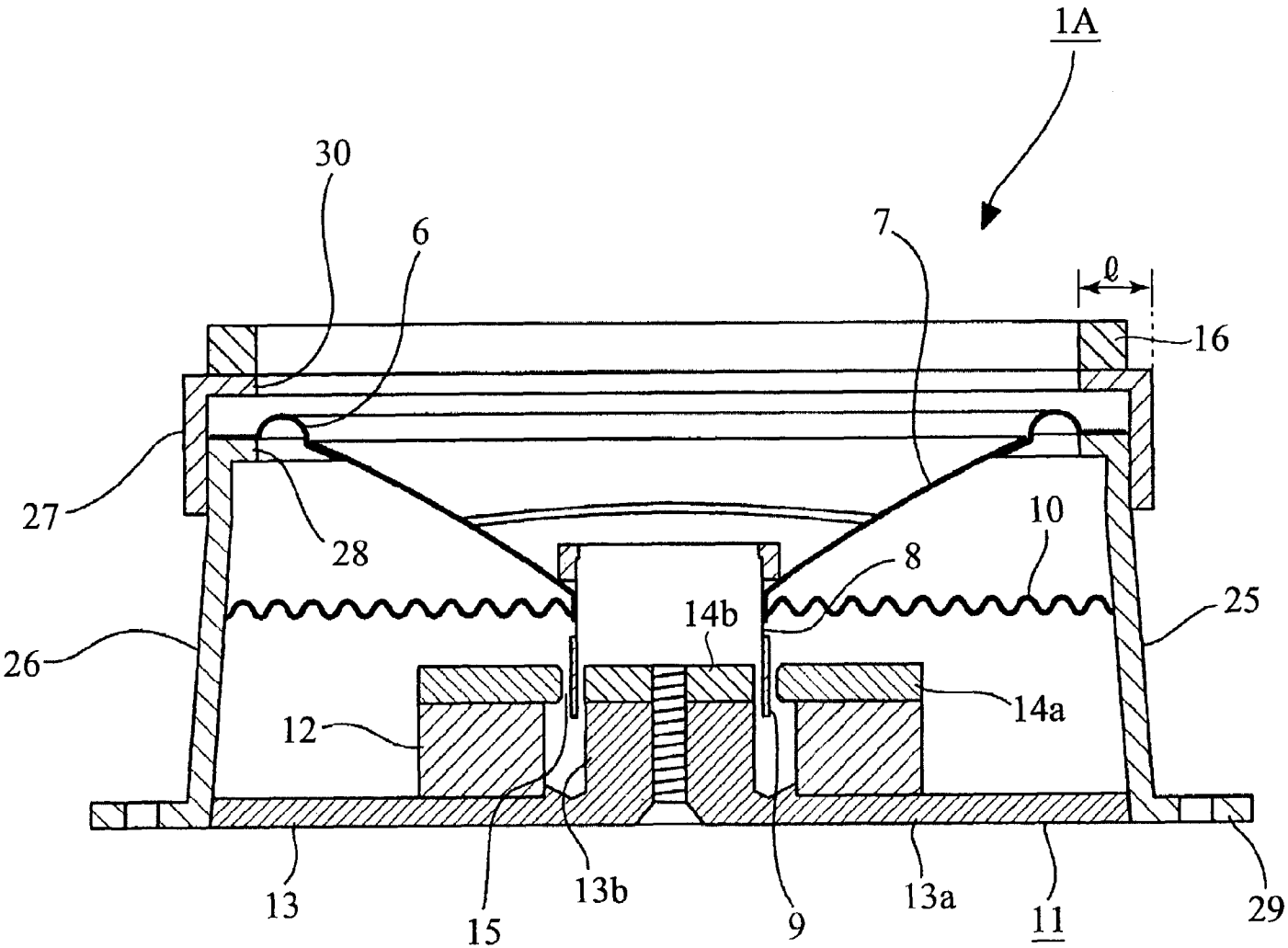
FIG. 4 is a longitudinal sectional view of a speaker according to a second embodiment of the present invention.
Figure 5:
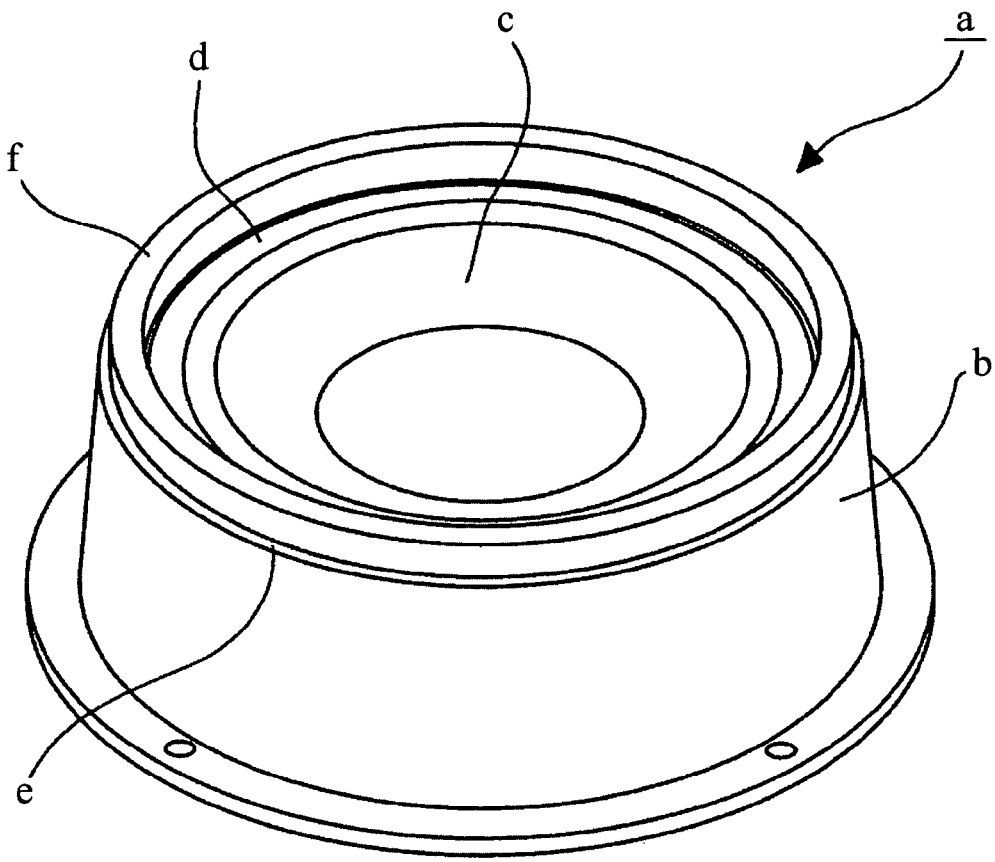
Fig. 5 PRIOR ART
FIG. 5 shows an example of a conventional speaker, in conjunction with FIG. 6, and is a schematic perspective view thereof.
Figure 6:
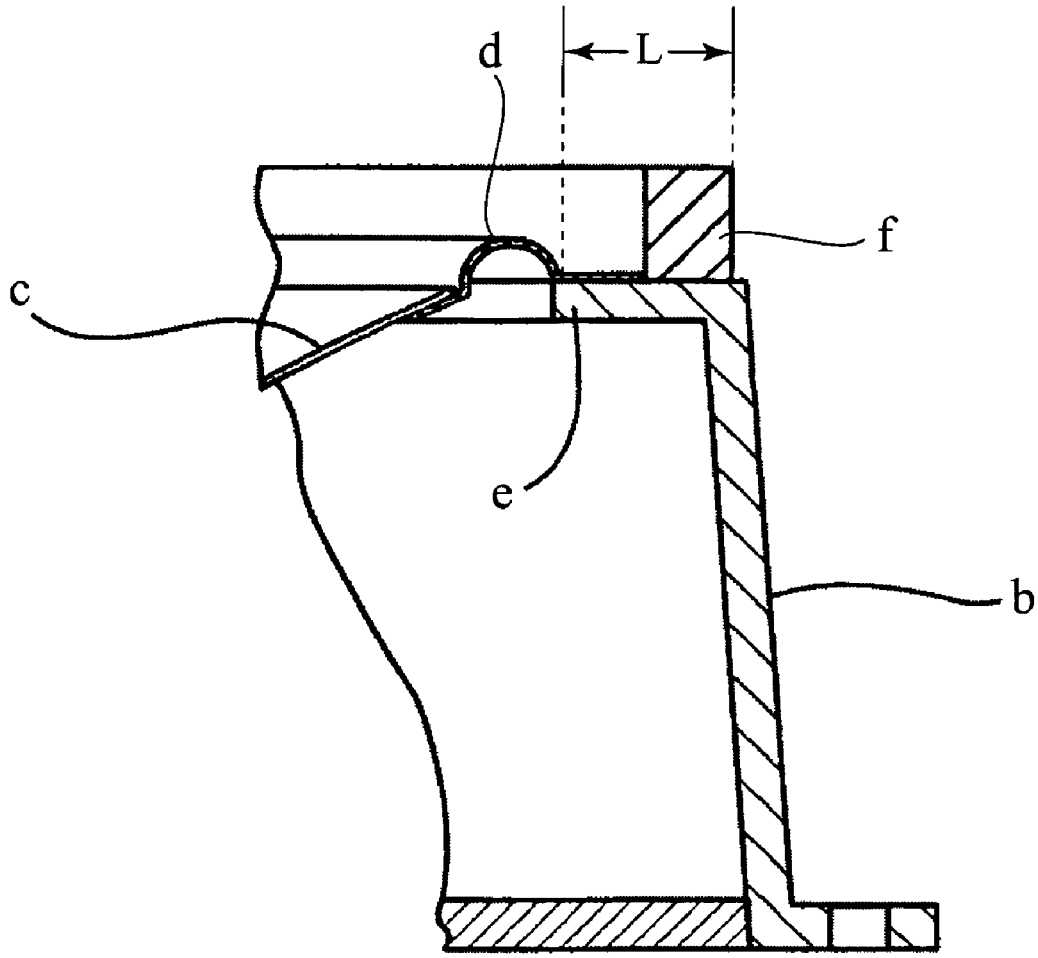
Fig. 6 PRIOR ART
FIG. 6 is a longitudinal sectional view showing the principal part.

FIG. 4 shows a speaker according to a second embodiment of the present invention.

A speaker 1A of the second embodiment is different from the speaker 1 of the first embodiment in that a frame 25 is composed of two sections, that is, has a so-called two-piece structure. Since other components are similar to those in the speaker 1 of the first embodiment, the similar components are denoted by the same numerals as those in the speaker 1 of the first embodiment, and descriptions thereof are omitted.

The frame 25 includes a substantially cylindrical main frame portion 26, and a damper-holding portion connected to the front end of the main frame portion 26, that is, a front frame portion 27. The main flame portion 26 is gently tapered so that its diameter is slightly larger at the rear end than at the front end. An edge flange portion 28 projecting inward is formed integrally with the front end of the main frame portion 26, and a mounting flange portion 29 projecting outward is formed integrally with the rear end of the main frame portion 26.

The front frame portion 27 is short in the axial direction (frontward and rearward direction), is substantially cylindrical, and is tapered so that its diameter is slightly larger at the rear end than at the front end. The inner diameter of the rear end of the front frame portion 27 is substantially equal to the outer diameter of the front end of the main frame portion 26 so that the rear end of the front frame portion 27 can be fitted on the front end of the main frame portion 26. A gasket flange portion 30 projecting inward is formed integrally with the front end of the front frame portion 27.

An edge 6 attached to the outer peripheral portion of a diaphragm 7 by, for example, bonding is mounted on the front face of the edge flange portion 28 of the main frame portion 26 by, for example, bonding. A magnetic circuit section 11 is supported in the main frame portion 26, and a portion of a coil bobbin 8 connected to the inner periphery of the diaphragm 7, on which portion a voice coil 9 is wound, is positioned in a gap 15 of the magnetic circuit section 11.

A gasket 16 is mounted on the front face of the gasket flange portion 30 of the front frame portion 27 by, for example, bonding.

The front frame portion 27 is fitted on the front end of the main frame portion 26 in which the diaphragm 7 and the magnetic circuit section 11 are supported, thereby constructing the speaker 1A.

While the front frame portion 27 may be fitted on the front end of the main frame portion 26 by various means, for example, screwing, engagement by an engaging claw, or welding such as ultrasonic welding, the fitting means is not particularly limited thereto.

In the speaker 1A of the second embodiment, the flange portion 30 for mounting the gasket 16 is also separate from the flange portion 28 for mounting the edge 6, and the gasket flange portion 30 is placed in front of the edge flange portion 28 so that at least a part thereof overlaps with the edge flange portion 28, as viewed from the front side. Therefore, there is no need to form a space outside the edge 6 in which the gasket 16 is placed. Consequently, Consequently, when the outer dimensions of the frame 25 are unchanged, the outer dimensions of the edge 6 can be made larger than those in the conventional art, and the outer dimensions of the diaphragm 7 can be increased. By increasing the outer diameter of the diaphragm 7, the frequency characteristics are improved, sound pressure is improved, and as a result, sound quality is improved.

In the speaker 1A of the second embodiment, although the number of components is increased because the frame 25 is composed of two members, a special jig is not needed to mount the edge 6, and the production process can be simplified.

In contrast, in the above speaker 1 of the first embodiment, since the edge flange portion 5 is placed behind the gasket flange portion 4, a special-purpose jig, for example, a pressure jig having a leading end that flares, is used, and it is necessary to perform a special step, for example, of bonding the edge 6 to the edge flange portion 5 with a pressure-activated adhesive activated by pressing the entire periphery of the edge 6 against the edge flange portion 5 by a roller while pressing several points on the edge 6 against the edge flange portion 5. While this slightly complicates the production process, the frame 2 can be formed in one piece, and the number of components can be reduced.

Accordingly, by properly using the speaker 1 of the first embodiment and the speaker 1A of the second embodiment according to the usage, the characters of the speakers can be exhibited satisfactorily. For example, by applying the speaker 1A of the second embodiment to speakers whose production is relatively small, large-scale production facilities are unnecessary, and this is suitable for low production of multiple types of speakers. In contrast, by applying the speaker 1 of the first embodiment when mass production is performed, the cost of the production facilities can be absorbed by reducing the parts cost, and inexpensive speakers can be provided.

Incidentally, the specific shapes and structures of the components described in the above embodiments are just examples that embody the present invention, and the technical scope of the present invention should not be restrictively interpreted according to them.

INDUSTRIAL APPLICABILITY

As described above, in the speaker of the present invention, the edge flange portion for supporting the edge and the gasket flange portion, which is placed in front of the edge flange portion so that at least a part thereof overlaps with the edge flange portion in the frontward and rearward direction, project inward at the leading end of the frame, and the gasket is supported by the gasket flange portion. Since the gasket flange portion for supporting the gasket is provided in front of the edge flange portion for supporting the edge, the outer diameter of the edge mounting portion will not be increased because of mounting of the gasket. Therefore, when the speaker has the same outer diameter as that of the conventional speaker, a diaphragm having an outer diameter larger than that of the conventional speaker can be used.

The invention claimed is:

1. A speaker comprising:

a diaphragm having a central aperture at which a bobbin with a voice coil wound therearound is mounted, an outer periphery of the diaphragm of the speaker being mounted to a frame of the speaker with an edge therebetween; and a magnetic circuit section having a magnetic gap in which the bobbin is placed, the magnetic circuit section of the speaker driving the diaphragm to vibrate in a frontward direction and a rearward direction, wherein the frame of the speaker is provided with an edge-mounting portion on which the edge is mounted, and a flange portion which projects toward a center in front of the edge-mounting portion and on which a gasket, the gasket having a central aperture therein, is mounted.

2. A speaker according to claim 1, wherein the edge-mounting portion and the flange portion are formed integrally with the frame.

3. A speaker according to claim 1, wherein a holding portion, having the flange portion on which the gasket is mounted, is formed separately from the frame having the edge-mounting portion, and is connected to the frame.

* * * * *